US009873060B2

(12) United States Patent
Aizato et al.

(10) Patent No.: US 9,873,060 B2
(45) Date of Patent: Jan. 23, 2018

(54) TOY

(71) Applicant: FUJITSU LIMITED, Kawasaki-shi, Kanagawa (JP)

(72) Inventors: Takami Aizato, Kawasaki (JP); Kazuki Osamura, Kawasaki (JP); Naoto Kawashima, Yokohama (JP); Yuma Kurihara, Ichikawa (JP); Kotaro Teranishi, Setagaya (JP); Hayato Nagoshi, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 0 days.

(21) Appl. No.: 15/195,284

(22) Filed: Jun. 28, 2016

(65) Prior Publication Data

US 2017/0028309 A1 Feb. 2, 2017

(30) Foreign Application Priority Data

Jul. 30, 2015 (JP) ..... 2015-151127

(51) Int. Cl.
*A63H 33/00* (2006.01)
*A63H 29/22* (2006.01)
*A63H 5/00* (2006.01)

(52) U.S. Cl.
CPC ..... *A63H 33/006* (2013.01); *A63H 5/00* (2013.01); *A63H 29/22* (2013.01); *A63H 2200/00* (2013.01)

(58) Field of Classification Search
CPC ..... A63H 13/20; A63H 29/22; A63H 33/006
See application file for complete search history.

(56) References Cited

U.S. PATENT DOCUMENTS 4,984,380 A * 1/1991 Anderson ..... A63H 33/006 40/455
6,238,263 B1 * 5/2001 Bennett ..... A63H 3/006 446/297
8,376,803 B2 * 2/2013 Oonaka ..... A63H 3/28 379/38
8,569,715 B1 * 10/2013 Tantillo ..... A61L 2/10 250/453.11
8,922,653 B1 * 12/2014 Reeve ..... H04N 7/181 348/143
9,597,805 B2 * 3/2017 Bender ..... B25J 11/009
2008/0020672 A1 * 1/2008 Osborn ..... A63H 33/006 446/227
2008/0176480 A1 * 7/2008 Gelfond ..... A63H 33/006 446/227
2010/0060448 A1 * 3/2010 Larsen ..... A63H 33/006 340/539.15
2010/0165091 A1 * 7/2010 Teranishi ..... G06K 9/00302 348/77

(Continued)

FOREIGN PATENT DOCUMENTS

JP 2005-223623 A 8/2005
JP 2009-205322 A 9/2009

*Primary Examiner* — Gene Kim
*Assistant Examiner* — Alyssa Hylinski
(74) *Attorney, Agent, or Firm* — Westerman, Hattori, Daniels & Adrian, LLP

(57) ABSTRACT

A toy according to an embodiment includes a human sensor, a processor configured to change the operation mode to a suppression mode in which an operation for amusing a target is suppressed when the human sensor detects an object.

7 Claims, 5 Drawing Sheets

(56) References Cited

U.S. PATENT DOCUMENTS

| | | | | |
|---|---|---|---|---|
| 2014/0137324 | A1* | 5/2014 | Doering | A47D 7/04 5/93.1 |
| 2015/0105608 | A1* | 4/2015 | Lipoma | A61B 5/6896 600/27 |
| 2015/0288877 | A1* | 10/2015 | Glazer | H04N 5/2251 348/77 |

* cited by examiner

TOY

CROSS-REFERENCE TO RELATED APPLICATION

This application is based upon and claims the benefit of priority of the prior Japanese Patent Application No. 2015-151127, filed on Jul. 30, 2015, the entire contents of which are incorporated herein by reference.

FIELD

The embodiment discussed herein is related to a toy.

BACKGROUND

Mobiles for amusing babies, by rotating objects such as dolls while playing melodies, have been conventionally known as a toy for babies and the like. A person who cares for a child such as a mother, who is called a parent hereinafter, makes use of a mobile to achieve a good balance between childcare and housework and the like by operating the mobile while doing housework and the like to cause the baby to gaze at the mobile. A related art example is disclosed in Japanese Laid-open Patent Publication No. 2009-205322.

However, the conventional technology has shortcomings that, when a parent attempts to amuse a baby with the mobile operating, the baby keeps on gazing at the mobile. The operation of the mobile may therefore obstruct the parent who is caring for the baby while amusing him/her, and the mobile has been sometimes insufficient in supporting childcare.

SUMMARY

According to an aspect of an embodiment, a toy includes a human sensor; and a processor configured to change an operation mode to a suppression mode in which an operation for amusing a target is suppressed when the human sensor detects an object.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENT

Figure 1:
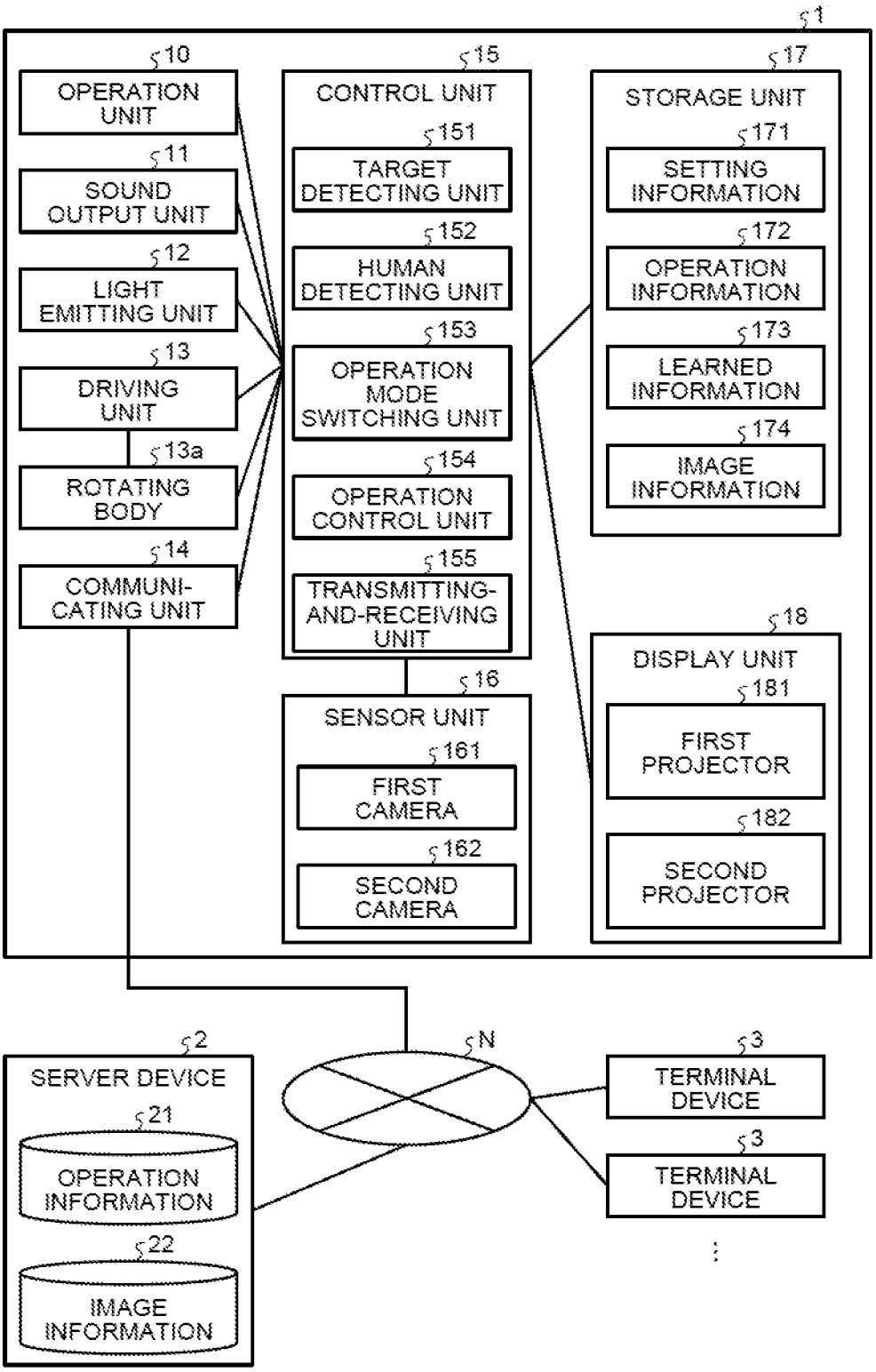
FIG. 1 is a block diagram illustrating an example of a system including a toy according to an embodiment of the present invention.

Preferred embodiments of the present invention will be explained with reference to accompanying drawings. In the embodiment, the configurations having the same functions are assigned with the same reference numerals, and duplicate explanations thereof are omitted herein. The toy explained below in the embodiment is merely an example, and is not intended to limit the embodiment thereto. The embodiments described below may be combined as appropriate, within the scope where such a combination is not contradictory. Furthermore, the embodiment below exemplifies a toy whose target to be cared is a baby, but the target to be cared may be not only babies but also pets, for example.

FIG. 1 is a block diagram illustrating an example of a system including a toy 1 according to an embodiment of the present invention. The system illustrated in FIG. 1 includes the toy 1, a server device 2, and a terminal device 3 that are communicatively connected to each other over a network N such as the Internet.

The toy 1 is a toy generally referred to as a mobile for amusing a baby who is a target through operations such as emitting light, rotating objects such as hanging ornaments and dolls, and playing melodies, for example. The toy 1 is a hanging toy installed above a baby who is lying down, for example, and amuses the baby by rotating the hanging ornaments, emitting light, and playing melodies. While the embodiment is an example of the toy 1 used in a manner hanging over the baby, it may be a toy used in a manner placed by the baby, and the way in which the toy is used is not limited to this particular example.

The server device 2 is an information processing apparatus such as a personal computer (PC), and provides various services to the toy 1 or the terminal device 3 connected over the network N. Specifically, the server device 2 transmits operation information 21 related to an operation of the toy 1, such as music, videos, light emissions, and rotations to the toy 1. The operation information 21 is a data file in which a specific operation (operation content), such as a piece of music, a video, a light emission and rotation pattern of the toy are described, and a piece of content suitable for the season, e.g., the Christmas season, is described. The toy 1 stores the operation information 21 received from the server device 2 in a storage unit 17 as operation information 172, and operates in accordance with the operation information 172 so that the toy 1 can perform the operation suitable for the season, for example.

The server device 2 provides an image distribution service for distributing image information 22 having been uploaded by the toy 1 to the terminal device 3. The image information 22 is a piece of data representing image information 174 which is an image of the baby who is a target. The image is captured by, stored in the storage unit 17 by, and uploaded to the server device 2 by the toy 1.

The terminal device 3 is a terminal that uses the image distribution service provided by the server device 2, and is an information processing apparatus such as a personal computer (PC), a smartphone, or a tablet terminal. The terminal device 3 accesses the server device 2 over the network N, downloads the image information 22 uploaded by the toy 1, and displays the image information 22 on a display. In this manner, a user of the terminal device 3 can check the image of the baby captured by the toy 1.

The toy 1 includes an operation unit 10, a sound output unit 11, a light emitting unit 12, a driving unit 13, a rotating bodies 13*a*, a communicating unit 14, a control unit 15, a sensor unit 16, the storage unit 17, and a display unit 18.

The operation unit 10 is, for example, operation buttons for receiving various operations (e.g., operation ON/OFF and various types of setting operations) from a user. The sound output unit 11 includes a sound synthesizer circuit and a speaker, for example, and outputs sound such as music under the control of the control unit 15.

The light emitting unit 12 is a light emitting diode (LED), for example, and emits light under the control of the control unit 15. The driving unit 13 is a motor, for example, that drives under the control of the control unit 15, The rotating bodies 13*a* are dolls and hanging ornaments, for example, rotated by the driving force of the driving unit 13, for performing rotation operations and the like for amusing a baby. The communicating unit 14 is a communication interface for performing data communication over the network N under the control of the control unit 15.

The control unit 15 is implemented by causing a central processing unit (CPU), a micro-processing unit (MPU), or the like to execute a computer program stored in an internal storage device, with a random-access memory (RAM) as a working area. The control unit 15 may also be implemented by an integration circuit such as an application specific integrated circuit (ASIC) or a field-programmable gate array (FPGA), for example. By causing the computer program to be executed, the control unit 15 implements functions of a target detecting unit 151, a human detecting unit 152, an operation mode switching unit 153, an operation control unit 154, and a transmitting-and-receiving unit 155 (details of all of which will be described later).

The sensor unit 16 is a sensor that detects the settings around the toy 1, and outputs the detected sensor information to the control unit 15. The sensor unit 16 includes, for example, a first camera 161 and a second camera 162. The first camera 161 is a digital camera that captures a target who is a baby who is lying down on the floor. For example, the first camera 161 captures an image in a direction from the bottom surface of the hanging toy 1 toward the floor (vertically downwardly), and captures an image of the baby who is lying down on the floor to detect the baby. The second camera 162 is a digital camera that captures an image of the settings around the toy 1. For example, the second camera 162 provided to a side surface of the toy 1 captures an image of the settings around the toy 1, and serves as a sensor for detecting a person who is around the toy 1 from the image in which the settings are captured.

The storage unit 17 is implemented as, for example, a RAM, a semiconductor memory element such as a flash memory, or a storage device such as a hard disk and an optical disk. The storage unit 17 stores therein setting information 171, the operation information 172, learned information 173, and the image information 174. The storage unit 17 also stores therein computer programs and the like related to the processes performed by the control unit 15.

The setting information 171 represents various settings of the toy 1, and includes an operation mode setting related to the operations of the toy 1 (details of which will be described later), and settings related to a user, for example. The settings in the setting information 171, such as the operation mode setting, are changed in response to a setting operation received via the operation unit 10, through a setting process performed by the control unit 15.

The operation information 172 is a data file in which a specific operation (content), such as music, videos, and light emission patterns and rotation patterns of the toy 1, are described, and pieces of information of an operation pattern for each operation identified by an operation identification (ID), for example, are described. The operation information 172 describes, for example, patterns of sound (e.g., melody content and a sound volume) to be output from the sound output unit 11, pieces of image data to be displayed on the display unit 18, patterns of the light emission (e.g., the timing at which and the time for which the light is emitted) from the light emitting unit 12, or driving patterns of the rotating bodies 13*a* (e.g., a rotating direction, a rotation amount, and rotation timing), for each of the operations.

The learned information 173 represents results of learning from the operations of the toy 1 that are based on the operation information 172. Specifically, the learned information 173 describes information representing an evaluation as to how much the operation identified by an operation ID, for example, is liked by the baby, based on the state (reaction) of the baby captured by the first camera 161. For example, the learned information 173 describes an evaluation score corresponding to the state of the detected baby (e.g., "crying", "laughing", "sleeping", and "no change") detected from the image captured by the first camera 161, for each of the operations of the toy 1 that are based the operation information 172.

The display unit 18 is a display device that displays images (videos) and the like under the control of the control unit 15. The display unit 18 includes, for example, a first projector 181 and a second projector 182. The first projector 181 is a liquid crystal projector that displays an image intended for the baby who is lying down on the floor. For example, the first projector 181 projects an image onto the bottom surface of the toy 1 to present the image intended for the baby who is lying down on the floor. The second projector 182 is a liquid crystal projector that displays an image intended for a person who is around the toy 1. For example, the second projector 182 projects an image onto the outer circumferential surface (side surface) of the toy 1 to present the image intended for a person who is around the toy 1.

Figure 2:
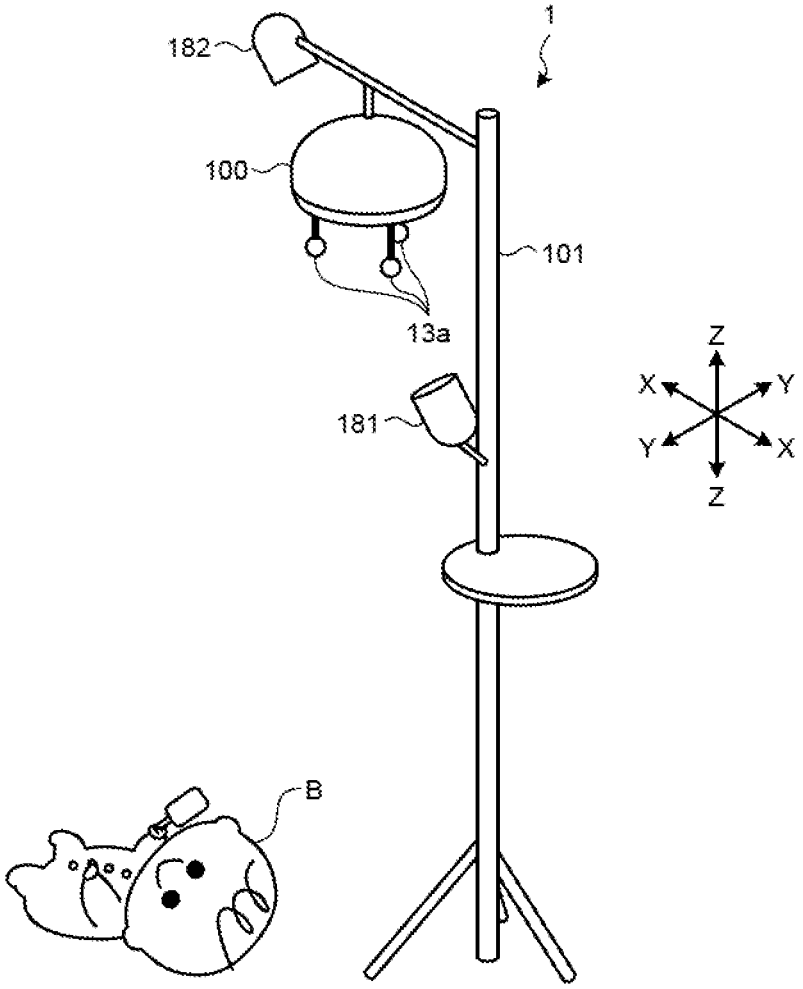
FIG. 2 is a schematic diagram for explaining an external view of the toy according to the embodiment.
Figure 3:
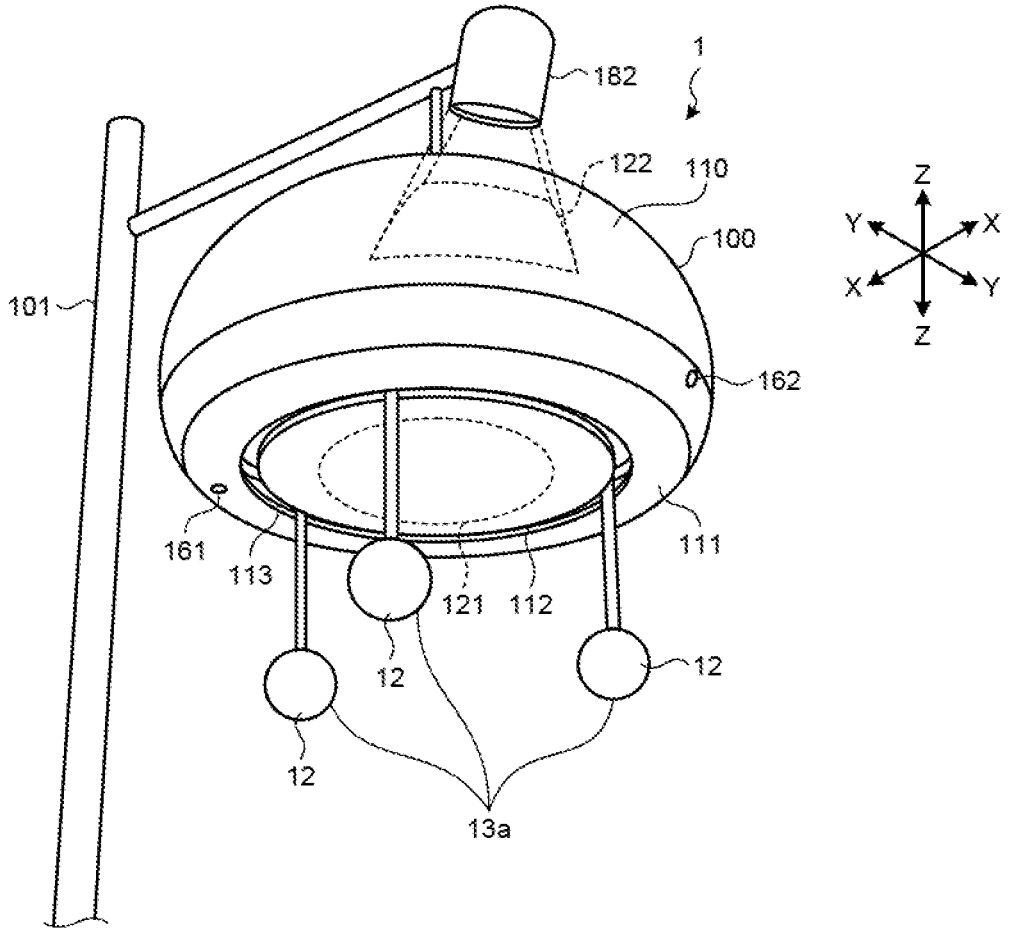
FIG. 3 is a schematic diagram for explaining the external view of the toy according to the embodiment.

FIGS. 2 and 3 are schematic diagrams for explaining the external view of the toy 1 according to the embodiment. As illustrated in FIG. 2, the toy 1 with a housing 100 having the rotating bodies 13*a* is hanged by a hanging rod 101 that is provided with the first projector 181 and the second projector 182, and installed above a baby B.

As illustrated in FIG. 3, the housing 100 includes an upper housing 110, a lower housing 111, and a bottom plate 112. The upper housing 110 has a dome-like shape, which is the shape of a bowl upside down. The upper-housing 110 is hanged by the hanging rod 101 at the apex of the dome with its lower portion of the dome connected to the lower housing 111. An image from the second projector 182 is projected onto a projection area 122 of the side wall of the upper housing 110. An image from the first projector 181 is projected onto a projection area 121 of the bottom plate 112.

The lower housing 111 is provided with the first camera 161 facing downwardly to where the baby B is with the second camera 162 provided laterally. This configuration enables the first camera 161 to capture an image of the baby B who is lying down on the floor, and enables the second camera 162 to capture the settings around the toy 1, other than the baby B who is lying down on the floor.

Between the lower housing 111 and the bottom plate 112, a ring-shaped gap 113 is provided. Hanging through the gap 113 are the rotating bodies 13*a* connected to the driving unit 13 that is internalized in the housing 100. The rotating bodies 13*a* are driven to rotate along the ring-shaped gap 113, or to move up and down by the power supplied by the driving unit 13. The light emitting unit 12 is provided to the tip of each of the rotating bodies 13*a*, and moves as the corresponding rotating body 13*a* moves.

Referring back to FIG. 1, the target detecting unit 151 detects the baby B, who is the target, based on the sensor information detected by the sensor unit 16. Specifically, the target detecting unit 151 detects the presence of the baby B by detecting whether the baby B is captured in the image captured by the first camera 161, using a known human detection technology. The target detecting unit 151 may also extract an area corresponding to the face of the baby B from the captured image, and detect the state of the baby B, e.g., "crying", "laughing", "sleeping", or "normal", using a known facial expression determining technology making use of the positions or the shape of the facial parts (e.g., the eyes, the mouth, and the nose) included in the extracted face area. Detection of the baby B, who is the target, is not limited to that using an image captured by the first camera 161, and the baby B may also be detected using a temperature distribution detected by an infrared sensor, without limiting to this particular example.

The human detecting unit 152 detects a person (other than the baby B, who is the target) who is around the toy 1, based on sensor information detected by the sensor unit 16. Specifically, the human detecting unit 152 detects the presence of a person by detecting a person captured by the second camera 162 in the image of the settings around the toy 1, using a known human detection technology. Detection of a person who is around the toy 1 is not limited to that using an image captured by the second camera 162, and a person may also be detected using a temperature distribution detected by an infrared sensor, without limiting to this particular example.

The human detecting unit 152 may also detect a person who is registered in advance, using a known face recognition technology for extracting the face area of a person included in the captured image, and comparing the extracted face area with the face image registered in advance. Specifically, a face image may be registered to the setting information 171 in advance as a user setting, and the human detecting unit 152 may perform a face authentication to detect the user having been registered in advance using the face image registered in the setting information 171. By registering the parent as a user, for example, in the manner described above, the human detecting unit 152 can detect the parent of the baby B.

The operation mode switching unit 153 switches an operation mode related to the operation of the toy 1. For example, the operation mode switching unit 153 uses an "amusing operation mode" for performing operations for amusing the baby B in response to the baby B being detected by the target detecting unit 151. The operation mode switching unit 153 uses a "suspension mode" for suspending the operations for the time in which the target detecting unit 151 does not detect the baby B. The operation mode switching unit 153 also selects a "support mode" for suppressing or stopping the operations for amusing the baby B in response to a person (other than the baby B, who is the target) being detected around the toy 1.

Figure 4:
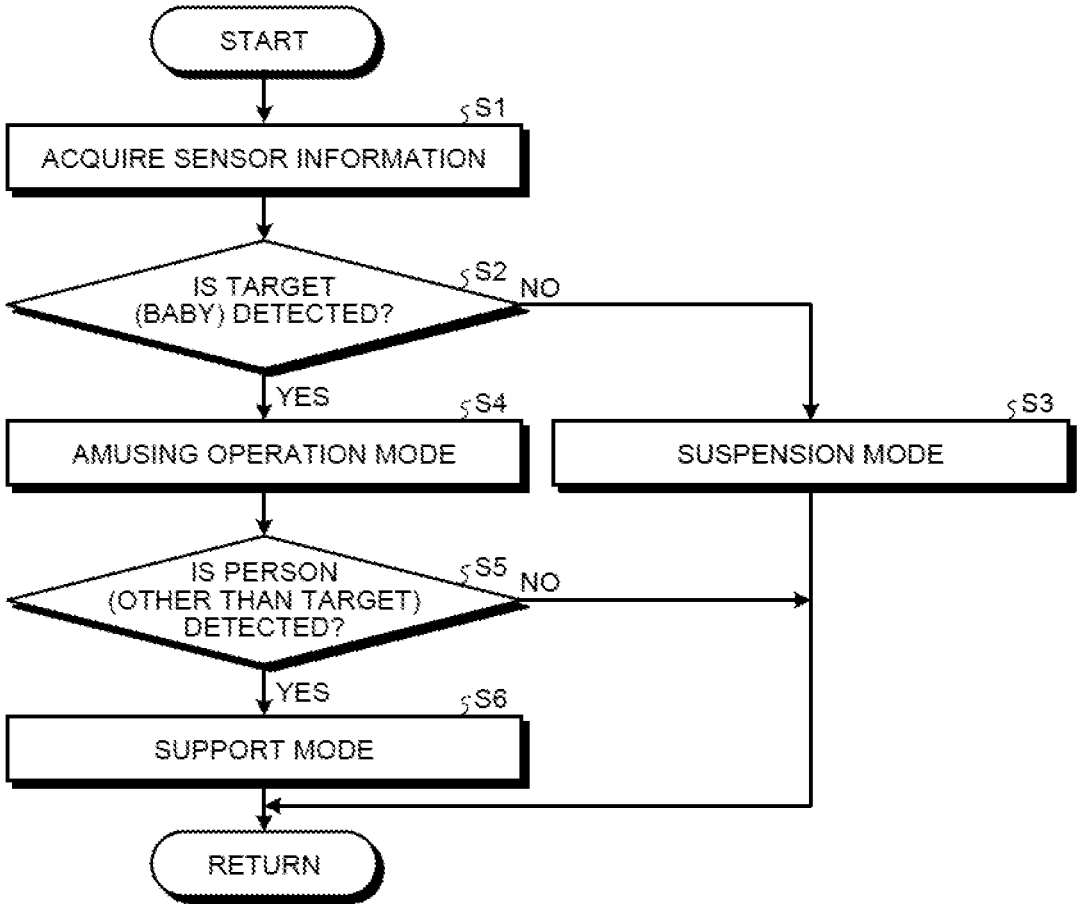
FIG. 4 is a flowchart illustrating an example of how an operation mode of the toy is switched according to the embodiment.

FIG. 4 is a flowchart illustrating an example of how the operation mode of the toy 1 is switched according to the embodiment. As illustrated in FIG. 4, the control unit 15 acquires the sensor information from the sensor unit 16 (S1). Based on the sensor information, the target detecting unit 151 detects the target (the baby B)/and the human detecting unit 152 detects a person who is around the toy 1 (other than the target).

The operation mode switching unit 153 determines whether the target (the baby B) is detected, based on the detection result of the target detecting unit 151 (S2). If the baby B is not detected (NO at S2), the operation mode switching unit 153 sets the operation mode to the "suspension mode" (S3), and shifts the process back to the start.

If the baby B is detected (YES at S2), the operation mode switching unit 153 sets the operation mode to the "amusing operation mode" (S4). The operation mode switching unit 153 then determines whether there is any person who is detected around the toy 1 (other than the target), based on the detection result of the human detecting unit 152 (S5).

If no one is detected around the toy 1 (NO at S5), the operation mode switching unit 153 keeps the operation mode to the "amusing operation mode", and shifts the process back to the start. If anyone is detected around the toy 1 (YES at S5), the operation mode switching unit 153 sets the operation mode to the "support mode" (S6), and shifts the process back to the start. The operation mode switching unit 153 switches the operation mode by repeating the process from S1 to S6 described above intermittently at a predetermined time interval.

Figure 5:
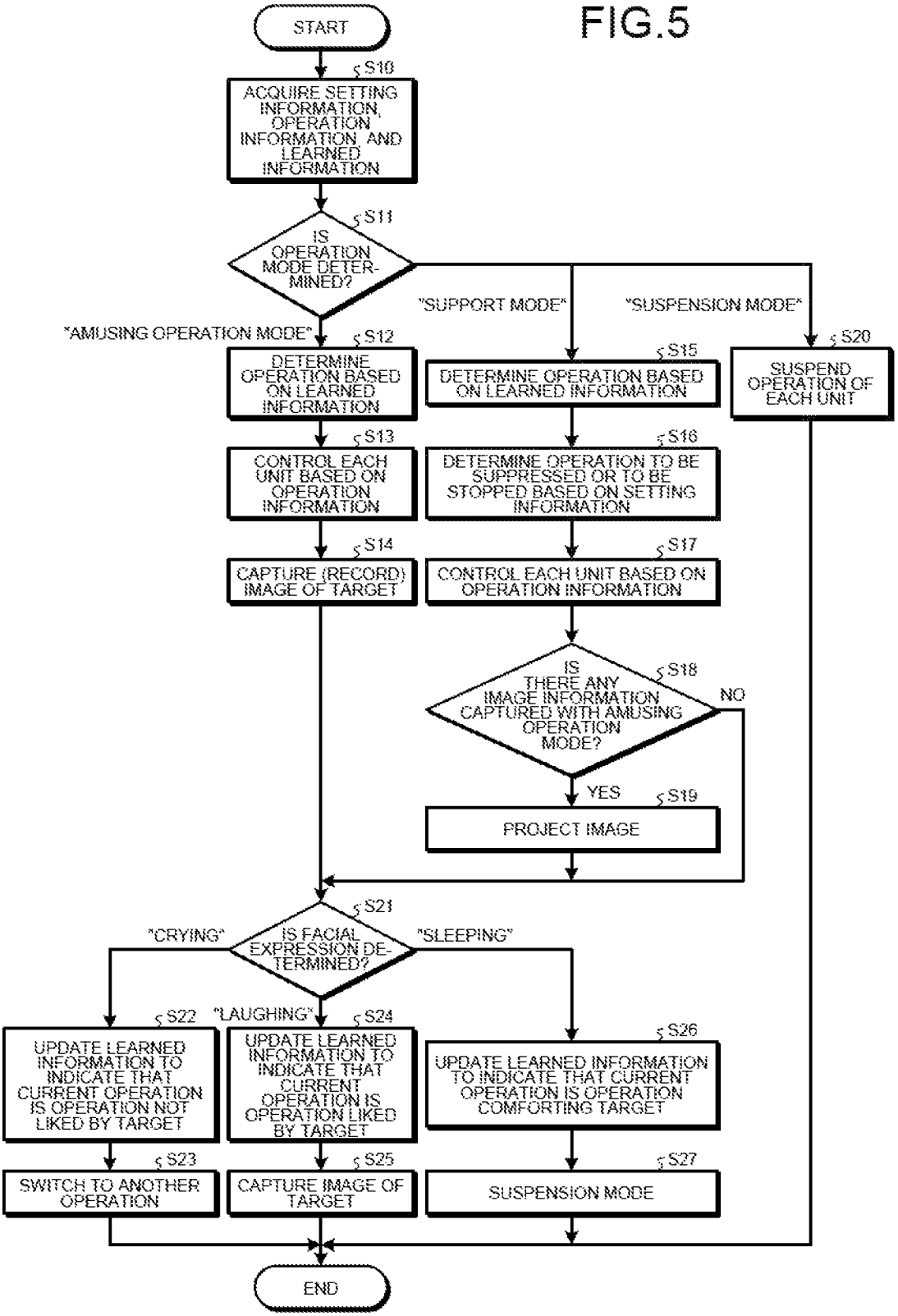
FIG. 5 is a flowchart illustrating an example of operation control of the toy according to the embodiment.

The operation control unit 154 controls the operations of the respective units included in the toy 1 based on the operation mode selected by the operation mode switching unit 153. FIG. 5 is a flowchart illustrating an example of the operation control of the toy 1 according to the embodiment.

As illustrated in FIG. 5, once the process is started, the operation control unit 154 acquires the setting information 171, the operation information 172, and the learned information 173 from the storage unit 17 (S10). The operation control unit 154 then determines which one of the operation modes is selected by the operation mode switching unit 153 (S11).

If the operation mode selected by the operation mode switching unit 153 is the "amusing operation mode" at S11, the operation control unit 154 selects an operation of the toy 1 from those specified in the operation information 172 based on the learned information 173 (S12). Specifically, the operation control unit 154 extracts an operation assigned with a high evaluation score in the learned information 173 from among the operations in the operation information 172, and provides this operation as the operation of the toy 1. In this manner, the operation that has been learned in advance as an operation liked by the baby B is provided as the operation of the toy 1.

The operation control unit 154 then controls the operations of the sound output unit 11, the light emitting unit 12, the driving unit 13, and the display unit 18 based on the operation information 172 related to the operation determined at S12 (S13). The operation control unit 154 then causes the first camera 161 to capture (record) the image of the target (the baby B) (S14), and stores the captured image data in the storage unit 17 as the image information 174. Before storing the information in the image information 174, the operation control unit 154 appends information such as a flag indicating that the image has been recorded in the "amusing operation mode" and the image capturing date and time to the captured image data, as the information of the captured image data, for example.

If the operation mode selected by the operation mode switching unit 153 is the "support mode" at S11, the operation control unit 154 selects an operation of the toy 1 among those specified in the operation information 172 based on the learned information 173 in the same manner as at S12 (S15). This causes the toy 1 to perform the operation having been learned in advance as the operation liked by the baby B.

The operation control unit 154 then determines the operations of the sound output unit 11, the light emitting unit 12, the driving unit 13, and the display unit 18 are to be suppressed or to be stopped, based on the setting information 171 (S16).

The operations of these units to be suppressed or stopped in the "support mode" are specified in the setting information 171 in advance. Specifically, the setting information 171 describes setting to suppress the rotation (to reduce the rotation quantity or the rotation speed) or setting to stop the rotation of the rotating bodies 13*a* when the "support mode" is selected. The setting information 171 also describes setting to suppress the sound (sound volume) or to stop the sound output from the sound output unit 11 when the "support mode" is selected. The setting information 171 also describes setting to suppress the light emission (to reduce the amount of light emission) or setting to stop the light emission from the light emitting unit 12 when the "support mode" is selected. The setting information 171 also describes setting to stop the display by the display unit 18 when the "support mode" is selected. Based on these settings described in the setting information 171, at S16, it is determined to suppress or to stop the operations of the sound output unit 11, the light emitting unit 12, the driving unit 13, and the display unit 18.

The operation control unit 154 then controls the operations of the sound output unit 11, the light emitting unit 12, the driving unit 13, and the display unit 18 based on the operation information 172 on the operation determined at S15 (S17). At this time, as to any operations for which determination to suppress or stop was made at S16, the operation control unit 154 is regarded to have followed the determination to suppress or stop the operations.

For example, when it is determined to suppress the sound and the light emission and to stop the rotation and the display at S16, the operation control unit 154 is regarded to have suppressed the operations of the sound output unit 11 and the light emitting unit 12 based on the operation information 172, according to the determination; and stops the operations of the driving unit 13 and the display unit 18 based on the operation information 172, according to the determination. In this manner, the operations of the units included in the toy 1 are suppressed or stopped in the "support mode" with someone being around the toy 1.

The operation control unit 154 then refers to the image information 174 in the storage unit 17 to determine whether there is any image information captured in the "amusing operation mode" (S18). Specifically, the operation control unit 154 determines whether there is any image information captured in the "amusing operation mode" based on whether the image information 174 includes any flag indicating that, the image has been recorded in the "amusing operation mode". If there is no image information captured in the "amusing operation mode" (NO at S18), the operation control unit 154 shifts the process to S21.

If there is some image information captured in the "amusing operation mode" (YES at S18), the operation control unit 154 reads the image captured in the "amusing operation mode" from the image information 174, and causes the second projector 182 to project the read image (S19). In this manner, the image captured in the "amusing operation mode" is projected to the projection area 122 in the "support mode" with someone being around the toy 1, is selected.

If the operation mode selected by the operation mode switching unit 153 is the "suspension mode" at S11, the operation control unit 154 suspends the operations of the sound output unit 11, the light emitting unit 12, the driving unit 13, and the display unit 18 (S20), and shifts the process back to the start.

In the subsequent process in the "amusing operation mode" or the "support mode", the operation control unit 154 determines the facial expression of the baby B (S21) based on the result of detection performed by the target detecting unit 151.

If the facial expression of the baby B is "crying" at S21, the operation control unit 154 updates the learned information 173 to indicate that the current operation at S13 or S16 is not an operation liked by the target (the baby B) (S22). Specifically, the operation control unit 154 updates the data of the learned information 173 on the current operation by adding a negative evaluation score corresponding to "crying" to the data. The operation control unit 154 then switches the current operation to another operation among the operations in the operation information 172 (S23), and shifts the process back to the start.

If the facial expression of the baby B is "laughing" at S21, the operation control unit 154 updates the learned information 173 to indicate that the current operation at S13 or S16 is an operation liked by the target (the baby B) (S24). Specifically, the operation control unit 154 updates the data of the learned information 173 on the current operation by adding a positive evaluation score corresponding to "laughing" to the data. The operation control unit 154 then causes the first camera 161 to capture the image of the target (the baby B) (S25), stores the captured image data in the storage unit 17 as the image information 174, and shifts the process back to the start. Before storing the image information 174, the operation control unit 154 appends information such as a flag indicating that the image has been recorded with the facial expression "laughing" and the image capturing date and time, as the information of the captured image data.

If the facial expression of the baby B is "sleeping" at S21, the operation control unit 154 updates the learned information 173 to indicate that the current operation at S13 or S16 is an operation comforting the target (the baby B) (S26). Specifically, the operation control unit 154 updates the data of the learned information 173 on the current operation, by adding a positive evaluation score corresponding to "sleeping". The operation control unit 154 then sets the operation mode to the "suspension mode", suspends the operations of the units (S27), and shifts the process back to the start.

The operation control unit 154 controls the operation of the units included in the toy 1 based on the operation mode established by the operation mode switching unit 153, by repeating the processes from S10 to S27 described above intermittently at a predetermined time interval.

Referring back to FIG. 1, the transmitting-and-receiving unit 155 transmits and receives data to and from the server device 2 over the communicating unit 14. Specifically, the transmitting-and-receiving unit 155 downloads the operation information 21 from the server device 2, to update the operation information 172 with the operation information 21. In this manner, the toy 1 can operate using the operation content distributed by the server device 2 in a manner suitable for the season, e.g., the Christmas season.

The transmitting-and-receiving unit 155 also reads the image information 174 from the storage unit 17, and uploads the image information 174 to the server device 2. In this manner, the toy 1 can distribute the image of the baby B captured by the first camera 161 to the terminal device 3 via the server device 2. The toy 1 may also distribute the image of the baby B captured by the first camera 161 automatically to a predetermined terminal device 3 via the server device 2.

As described above, the toy 1 includes the sensor unit 16 that detects a person who is around the toy 1, The toy 1 also includes the operation mode switching unit 153 that changes the operation mode to the "support mode" for suppressing the operation for amusing the baby B, who is the target, when a person is detected in the sensor information of the sensor unit 16. In this manner, the toy 1 suppresses its operation while the parent is caring for (rearing) the baby B by amusing the baby B around the toy 1. Therefore, the toy 1 can support childcare smoothly without obstructing the parent with the operation.

Although explained as an example in the embodiment is a system configuration using the toy 1, the embodiment is not limited to this system configuration. For example, when a system is not configured to cause the server device 2 to update the operation information 172 or to distribute the image information 174 to the terminal device 3, the system may be configured with the toy 1 alone. Furthermore, the control unit 15 of the toy 1 may be implemented as an external device (computer) such as a smartphone that is connected wirelessly, for example, in accordance with a communication standard such as Bluetooth (registered trademark) Low Energy (BTLE). Specifically, the control unit 15 may be implemented by causing an external device to execute an application program having the functions equivalent to those of the target detecting unit 151, the human detecting unit 152, the operation mode switching unit 153, the operation control unit 154, and the transmitting-and-receiving unit 155.

The computer program executed by the toy 1 or the external device can be distributed to a computer over a communication network such as the Internet. The computer program may be recorded in a computer-readable recording medium such as a memory or a hard disk provided to a computer, and may be read and executed by a computer.

According to one embodiment of the present invention, the toy can support childcare.

All examples and conditional language recited herein are intended for pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although the embodiment, of the present invention has been described in detail, it should be understood that the various changes, substitutions, and alterations could be made hereto without departing from the spirit and scope of the invention.

What is claimed is:

1. A toy comprising:

a human sensor;

an image capturing device that captures an image of a target;

a display device; and a processor configured to:

change an operation mode to a suppression mode in which an operation for amusing the target is suppressed when the human sensor detects an object;

store therein the image captured by the image capturing device; and display the captured image on the display device when the operation mode is the suppression mode.

2. The toy according to claim 1, further comprising:

a rotating body; and a sound output device, wherein the suppression mode is an operation mode in which a rotation of the rotating body is suppressed or stopped, and the sound output device is caused to output music.

3. The toy according to claim 1, further comprising:

a rotating body;

a sound output device; and a light emitting device, wherein the suppression mode is an operation mode in which a rotation of the rotating body is suppressed or stopped, sound output from the sound output device is suppressed or stopped, and light emission from the light emitting device is suppressed or turned off.

4. The toy according to claim 1, wherein the processor executes a process comprising;

detecting a state of the target; and storing therein learned information corresponding to the state of the target, in response to operation control for amusing the target, wherein the processor performs the operation control for amusing the target based on the learned information.

5. The toy according to claim 1, further comprising a transmitting device that transmits the captured image to an external device.

6. The toy according to claim 1, further comprising a communicating device that acquires operation information from a server that stores therein the operation information, wherein the processor executes a process comprising;

controlling the operation for amusing the target based on the acquired operation information.

7. A toy comprising:

at least one of a movable device, a light emitting device, or a sound output device;

a processor configured to perform at least one of movement control of the movable device, light emission control of the light emitting device, and sound production control of the sound output device;

an image capturing device that captures an image of a target;

a display device; and a human sensor, wherein the processor is further configured to:

store therein the image captured by the image capturing device; and suppress, when the human sensor detects an object, at least one of an amount of movement achieved by the movement control, an amount of light emission achieved by the light emission control, and a volume of sound achieved by the sound output control, and display the captured image on the display device.

* * * * *